US012246896B2

(12) United States Patent
Berroa Garcia

(10) Patent No.: US 12,246,896 B2
(45) Date of Patent: Mar. 11, 2025

(54) CAPPING DEVICE COMPRISING A CAP HINGED TO A BASE

(71) Applicant: BETAPACK, S.A.U., Irun (ES)

(72) Inventor: Francisco Javier Berroa Garcia, Gipuzkoa (ES)

(73) Assignee: BETAPACK, S.A.U., Irun (ES)

( * ) Notice: Subject to any disclaimer, the term of this patent is extended or adjusted under 35 U.S.C. 154(b) by 13 days.

(21) Appl. No.: 18/271,907

(22) PCT Filed: Jan. 10, 2022

(86) PCT No.: PCT/EP2022/050318
§ 371 (c)(1),
(2) Date: Jul. 12, 2023

(87) PCT Pub. No.: WO2022/152645
PCT Pub. Date: Jul. 21, 2022

(65) Prior Publication Data

US 2024/0083644 A1 Mar. 14, 2024

(30) Foreign Application Priority Data

Jan. 12, 2021 (EP) ..... 21382006

(51) Int. Cl.
*B65D 55/16* (2006.01)
*B65D 41/34* (2006.01)
*B65D 47/14* (2006.01)

(52) U.S. Cl.
CPC ..... *B65D 55/16* (2013.01); *B65D 41/3447* (2013.01); *B65D 47/142* (2013.01); *B65D 2401/30* (2020.05)

(58) Field of Classification Search
CPC .. B65D 55/16; B65D 41/3447; B65D 47/142; B65D 2401/30; B65D 2251/1008
See application file for complete search history.

(56) References Cited

U.S. PATENT DOCUMENTS 9,415,909 B2 * 8/2016 Druitt ..... B65D 47/0809
2018/0086510 A1 3/2018 Berroa Garcia

FOREIGN PATENT DOCUMENTS

EP 1406820 A2 4/2004
EP 3722223 A1 10/2020
EP 3741703 A1 * 11/2020 ..... B65D 41/3447
(Continued)

OTHER PUBLICATIONS

English translation of EP 3741703 A1. (Year: 2024).*
International Search Report from corresponding PCT Application No. PCT/EP2022/050318, mailed Apr. 14, 2022.

*Primary Examiner* — James N Smalley
(74) *Attorney, Agent, or Firm* — ArentFox Schiff LLP; Joseph M. Maraia; Marlo Schepper Grolnic

(57) ABSTRACT

The invention refers to a capping device (1) which includes:
a base (9) intended to be fixed to a container (2);
a cap (8) including an upper wall and an external peripheral skirt (11); and
an articulation device including at least one first lamella (19) connecting the outer peripheral skirt (11) of the cap (8) to the base (9, 109), presenting the external peripheral skirt (11) a first recessed portion (21) being the first lamella (19) attached to the upper edge (23) of the first recessed portion (21), including the cap (8), in addition, at least one first anti-intrusion veil (29).

9 Claims, 5 Drawing Sheets

(56) References Cited

FOREIGN PATENT DOCUMENTS

| | | | |
|---|---|---|---|
| KR | 100997319 | B1 | 11/2010 |
| TW | 201144172 | A | 12/2011 |
| WO | 2003006333 | A3 | 2/2004 |
| WO | 2006027484 | A1 | 3/2006 |
| WO | 2011090278 | A2 | 7/2011 |
| WO | 2020193821 | A1 | 10/2020 |

* cited by examiner

CAPPING DEVICE COMPRISING A CAP HINGED TO A BASE

CROSS-REFERENCE TO RELATED APPLICATIONS

This application is the U.S. national phase entry under 35 U.S.C. § 371 of International Application No. PCT/EP2022/050318, filed Jan. 10, 2022, entitled CAPPING DEVICE COMPRISING A CAP HINGED TO A BASE, which in turn claims priority to European Patent Application No. EP 21382006.1, filed Jan. 12, 2021, the contents of which are incorporated herein by reference in their entirety for all purposes.

TECHNICAL FIELD

The invention relates to a capping device comprising a base intended to be attached to a container, a cap and an articulation device connecting the cap to the base.

The invention relates, in particular, to capping devices in which the base is a lower ring which is intended to be retained over the neck of the container, as well as those where the base includes a pouring element that is intended to be fixed to the neck of a container.

TECHNOLOGICAL BACKGROUND

In the state of the art, some capping devices are known that include a base destined to be fixed to a neck of a container and a cap articulated on that base by an articulation device. The cap includes an upper wall and an external peripheral skirt that extends downward from the outer periphery of the upper wall.

The articulation device enables the movement of the cap between a closing position where the top wall of the cap closes an orifice of the container or pouring element and an open tilted position wherein the cap is detached from said orifice. The articulation device includes one or more hinge-forming lamellas that connect the cap to the base. In order to allow the lamellas to be long enough to allow movement of the cap between the closed position and the open tilted position, the outer peripheral skirt of the cap includes a few recessed portions, and the lamellas each converge with the peripheral skirt of the cap at the level of the upper edge of one of those recessed portions, so that the lamella extends over the bottom edge of the outer peripheral skirt of the cap.

Such capping devices are, for example, described in documents EP1406820, US2018086510, WO20193821 or EP3722223.

Capping devices of this type are typically made of polymeric material by molding procedures. In each portion intended for the realization of a recessed portion that receives a lamella, the mold includes two sheets that reach each side of each lamella to be molded, between the lamella and the external peripheral skirt. The sheets generally have a relatively important thickness, typically in the order of 0.3 mm to 1.5 mm, to give them sufficient strength.

In this way, the recessed portions form interstices on each side of each lamella that have an important width, typically greater than 0.5 mm. However, these interstices are susceptible to host unwanted particles, dust or organisms. Therefore, capping devices of this type are not fully satisfactory.

SUMMARY

One idea at the base of the invention is to propose a capping device of the aforementioned type in which hygiene and safety are improved.

According to one embodiment, the invention provides a capping device that includes:

a base intended to be fixed to a container;

a cap that includes an upper wall and an external peripheral skirt, being the cap appropriate and being intended to be arranged in a closing position in which the upper wall covers a orifice; and an articulation device that connects the cap to the base, including the articulation device at least one first lamella that connects the outer peripheral skirt of the cap to the base, presenting the external peripheral skirt a first recessed portion that includes an upper edge extending above a lower edge of the external peripheral skirt and a first side edge connecting the upper edge of the first recessed portion to the lower edge of the external peripheral skirt, the first lamella being attached to the upper edge of the first recessed portion, including the cap, in addition, at least one first anti-intrusion veil that has a thickness smaller than that of the outer peripheral skirt, extending the anti-intrusion veil from the upper edge of the first recessed portion and from the first side edge of the first recessed portion, inside the first recessed portion.

In this way, allowing the anti-intrusion veil to prevent the outer bodies from becoming housed in at least one area of the recessed portion, the hygiene and safety of the capping device are improved.

In addition, since the anti-intrusion veil has a thickness smaller than that of the external peripheral skirt, the functional features of the hinge are little or not at all degraded.

According to other advantageous embodiments, a capping device of this type may have one or more of the following features.

According to one embodiment, the first anti-intrusion veil has a thickness between 0.05 and 0.5 mm.

According to one embodiment, the first anti-intrusion veil includes a lower free edge extending into the extension of the lower edge of the external peripheral skirt.

According to one embodiment, the first anti-intrusion veil includes a side free edge that extends parallel to a side edge of the first lamella.

According to one embodiment, the side free edge of the first anti-intrusion veil is separated from an adjacent side edge of the first lamella by an interstice with a width between 0.01 and 0.4 mm. In this way, the interstice is sufficiently narrow to prevent most of the outer bodies from staying there, being at the same time important enough not to run the risk of disturbing the functionalities of the lamellas and to be compatible with the restrictions of the molding procedure.

According to another embodiment, the first anti-intrusion veil extends, in addition, from a side edge of the first lamella. Therefore, there is no interstice between the first anti-intrusion veil and the adjacent lamella.

According to one embodiment, the first recessed portion includes a second side edge that connects the upper edge of the first recessed portion to the lower edge of the outer peripheral skirt, being the first side edge and the second side edge of the first recessed portion arranged on each side of the first lamella, including the cap, in addition, a second anti-intrusion veil that has a thickness smaller than that of the external peripheral skirt, extending the second anti-intrusion veil from the upper edge of the first recessed portion and from the second side edge of the first recessed portion, inside the first recessed portion.

According to one embodiment, the articulation device includes a second lamella that connects the outer peripheral skirt of the cap to the base, presenting the external peripheral skirt a second recessed portion including an upper edge extending above the lower edge of the external peripheral skirt and a first side edge connecting the upper edge of the second recessed portion to the lower edge of the external peripheral skirt, being this second lamella attached to the upper edge of the second recessed portion, including the cap, in addition, for each of the first and second recessed portions at least one first anti-intrusion veil that has a thickness smaller than that of the outer peripheral skirt and extends from the upper edge and the first side edge of the first or second recessed portion, inside the first or second recessed portion.

According to one embodiment, the base includes a bottom ring that is intended to be retained at the neck of the container.

According to one embodiment, the base includes a pouring element that is intended to be integral with the neck of the container.

According to one embodiment, the capping device is made of polymeric material by a molding procedure.

According to one embodiment, the capping device is molded in one piece.

According to one embodiment, the invention also provides a container equipped with a neck that includes an orifice and a capping device mentioned above, with the base of said capping device fixed to the container.

The invention relates, in particular, to capping devices made of polymeric material and obtained by an injection molding procedure.

BRIEF DESCRIPTION OF THE FIGURES

The invention will be better understood and other purposes, details, features and advantages of the invention will become more clearly evident in the course of the following description of various particular embodiments of the invention, given only for illustrative and non-limiting purposes, with reference to the attached drawings.

DESCRIPTION OF THE EMBODIMENTS

In the description and figures, the X-axis corresponds to a central axis of the capping device intended to be positioned orthogonally to the plane of the orifice to be sealed when the capping device is in the closed position. The X-axis thus corresponds to the rotation axis of the cap of the capping device when the capping device is screwed over the neck of the container. By convention, the "radial" orientation is directed orthogonally to the X-axis and the axial orientation is directed parallel to the X-axis The terms "external" and "internal" are used to define the relative position of an element with respect to another, by reference to the X-axis, an element close to the X-axis is thus described as internal as opposed to an external element located radially on the periphery. The terms "upper" and "lower" are used to define the relative position of one element with respect to another by reference to a position wherein the neck orifice is directed upwards and the cap is in the closed position.

In relation to FIGS. 1 and 3 to 5, below, a capping device 1 according to a first embodiment is described. The capping device 1 is intended to be fixed to a container 2 fitted with a neck 3, represented in particular in FIG. 2.

The capping device 1 is molded, in a single piece of synthetic matter, such as polyethylene and advantageously high density polyethylene. Advantageously, the capping device 1 is molded into the configuration of FIG. 1 i.e. in a closed position, a position in which it can be mounted directly on the neck 3 of the container 2.

Figure 2:
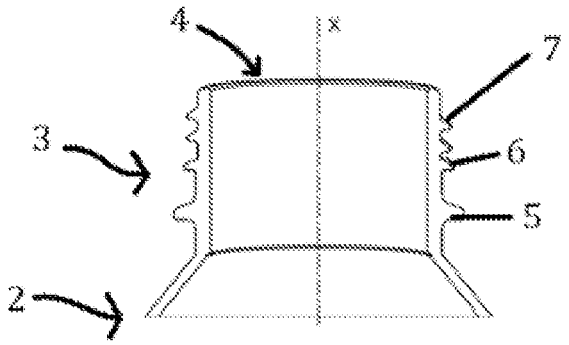
FIG. 2 is a cutaway view of a container neck intended to receive the capping device in FIG. 1.

As shown in FIG. 2, the neck 3 of the container 2 includes an upper end in which an orifice 4 is enabled allowing the contents of the container 2 to be poured. The neck 3 of the container 2 includes a support collar 5 which protrudes radially to the outside and a coupling collar 6 which likewise protrudes radially to the outside and which is arranged axially between the support collar 5 and the orifice 4. In the embodiment shown, the neck 3 also includes axially positioned between the coupling collar 6 and the orifice 4, a helical thread 7 which is intended to cooperate with a helical thread formed on the cap 8 of the capping device 1.

The capping device 1 includes a base 9 which is intended to be fixed to the neck 3 of the container 2, a cap 8 that is intended to cover the orifice 4 of the container 2 for sealing and an articulation device that joins the cap 8 to the base 9.

Figure 1:
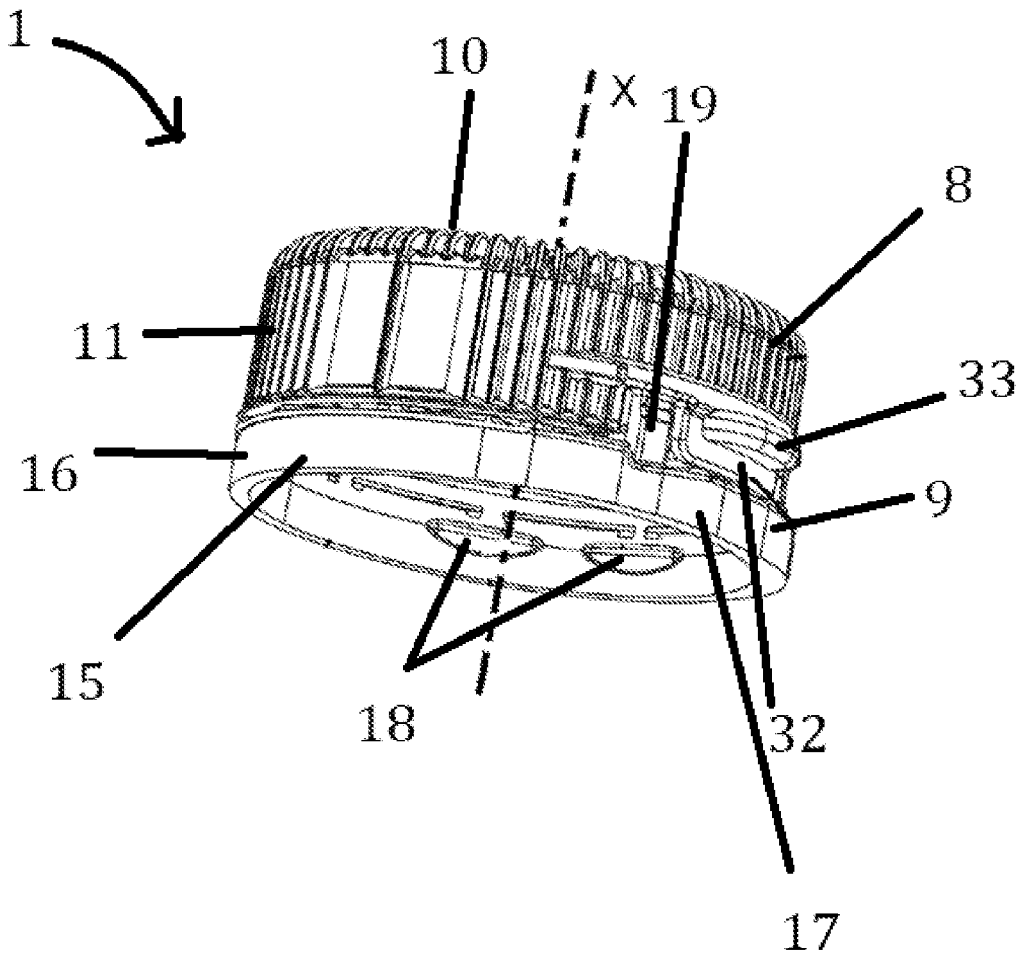
FIG. 1 is a three-quarter perspective view of a capping device according to a first embodiment.

As shown, specifically, in FIG. 1 the cap 8 includes an upper wall 10 intended to be arranged substantially orthogonal to the X-axis, in front of the orifice 4 of the neck 3 when said cap 8 is in a closed position. The cap 8 also includes an external peripheral skirt 11 extending, downwards, perpendicularly to the upper wall 10, from the external periphery of said upper wall 10. In the embodiment of FIGS. 1 and 2 to 5, the external peripheral skirt 11 is intended to surround the neck 3 of the container 2 when the cap 8 is in the closed position. The external peripheral skirt 11 also includes a helical thread 12 that is enabled on its internal face.

Figure 4:
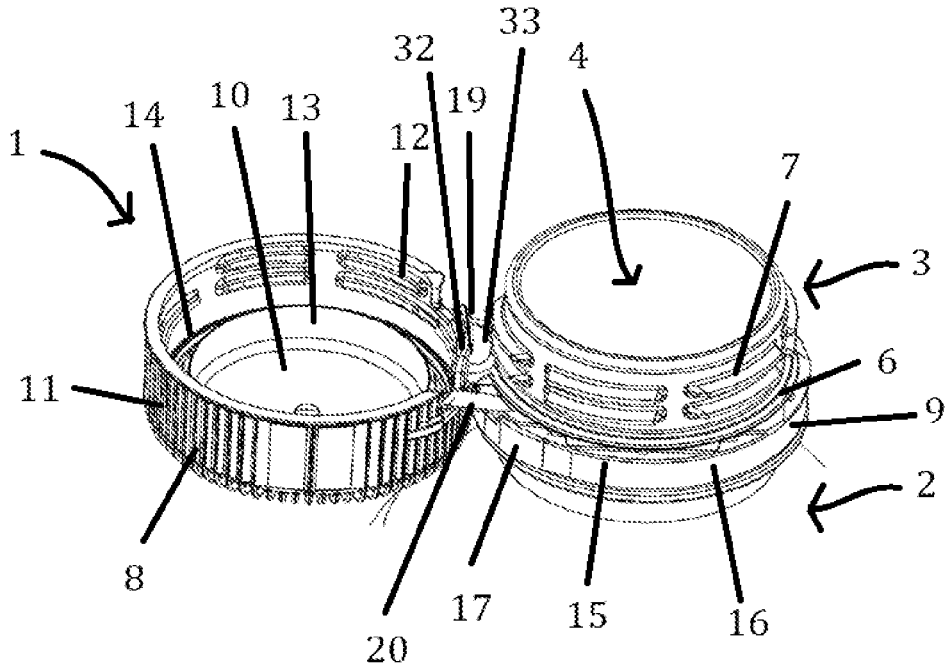
FIG. 4 is a perspective view of the capping device in FIG. 1 mounted on the neck of the container and representing the capping device cap in an open, tilting position wherein the cap is detached from the neck orifice.

As depicted, specifically, in FIG. 4, the cap 8 includes an internal skirt 13, which extends perpendicularly downwards from the upper wall 10 of the cap 8 and is sized to be inserted into the inside of the orifice 4 of the neck 3. The cap 8 also includes an annular lip 14 extending, from the upper wall 10, radially between the internal skirt 13 and the external peripheral skirt 11. The inner skirt 13 and the annular lip 14 are sized so that, when the cap 8 is in the closed position, on the neck 3 of the container 2, the inner skirt 13 is in contact with the inner face of the neck 3, while annular lip 14 is in contact against the outer face of neck 3. In this way, the inner skirt 13 and annular lip 14 ensure seal tightness.

Figure 3:
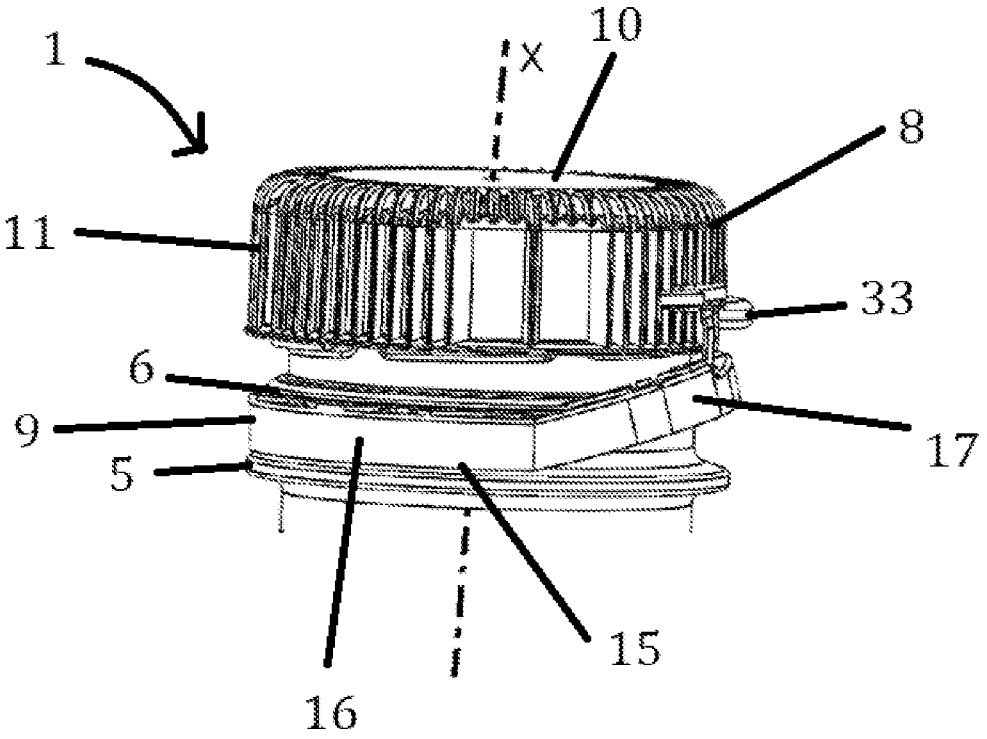
FIG. 3 is a side view of the capping device in FIG. 1 mounted on the neck of the container and representing the cap of the capping device in a released position wherein it is no longer in an engagement with the neck of the container.

In this first embodiment, the base 9 consists of a lower ring 15 which is retained on the neck 3 of the container 2. The lower ring 15 is held axially over the neck 3 of the container 2 and can at the same time rotate with respect to it around the X-axis. As shown in FIG. 3, the lower ring 15 includes two parts that are articulated in one another, namely a first section 16 and a second section 17 by which the lower ring 15 is attached to the cap 8 by means of the articulation device. The second section 17 is suitable for pivoting upwards with respect to the first section 16, between a lowered position in which the second section 17 is intended to be arranged below the coupling collar 6 and a raised position, in which the second section 17 is arranged at least partly above the coupling collar 6. This allows the cap 8 to move upwards with respect to the neck 3 of the container 2, until the helical thread 12 of the cap 8 is disengaged from the helical thread 7 enabled on the neck 3 of the container 2. In other words, when the cap 8 is unscrewed, the lower ring 15 is dragged in rotation around the X-axis, while the second section 17 of the lower ring 15 pivots with respect to the first section 16 to the raised position to enable an axial movement, upwards of the cap 8, from the closed position, to a released position shown in FIG. 3. When the cap 8 is pivoted from the released position toward the open tilted position, shown in FIG. 4, the second section 17 of the lower ring 15 pivots in reverse with respect to the first section 16 and then finds the lowered position again. On the other hand, the second section 17 pivots, equally, with respect to the first section 16 of the lowered position toward the raised position when the cap 8 is pivoted from the open tilted position toward the released position.

The lower ring 15 is held axially over the neck 3 of the container 2 by means of the coupling collar 6. As shown in FIG. 2, the coupling collar 6 has a frustoconical outer surface that narrows upwards, that is, in the direction of the orifice 4 of the container 2. The coupling collar 6 delimits, downward, that is, in a direction away from orifice 4, a shoulder.

As shown in FIG. 1 the first section 16 of the lower ring 15 includes some engaging elements 18 which cooperate with the coupling collar 6 enabled on the container 2, in order to retain axially the lower ring 15 at the neck 3 of the container 2. The engaging elements 18 are protrusions which protrude radially inwards from the first section 16 of the lower ring 15. During the assembly of the capping device 1 over the neck 3 of the container 2, the engaging elements 18 slide against the round-shaped surface of the coupling collar 6, then they are locked by elastic return behind the coupling collar 6.

Advantageously, the lower ring 15 is, before the first opening of the container 2, connected to the cap 8 by a few frangible bridges, not visible in the figures, intended to break during the opening of the cap 8. These bridges are thus indicators of inviolability.

The articulation device enables the movement of the cap 8 between the released position, represented in FIG. 3, in which, the cap 8 is no longer in engagement with the neck 3 and the open tilted position, represented in FIG. 4, in which the cap 8 is detached from the orifice 4 of the neck 3, so that it does not hinder the pouring of the contents of the container 2.

In relation to FIG. 5, the articulation device is described below. The articulation device includes two lamellas 19, 20 that connect the cap 8 and, more particularly, the external peripheral skirt 11, to the lower ring 15 and, more particularly, to the second section 17 of the lower ring 15.

The external peripheral skirt 11 includes two recessed portions 21, 22. Each recessed portion 21, 22 is defined by an upper edge 23 extending circumferentially around the X-axis, at a distance from the lower edge 24 of the outer peripheral skirt 11 and by two side edges 25, 26 extending respectively from one and the other of the two ends of the upper edge 23 and converging with the lower edge 24 of the outer peripheral skirt 11. Lamellas 19, 20 each converge with the upper edge 23 of one of the recessed portions 21, 22. Likewise, the lower ring 15 also includes two recessed portions 27, 28 and the lamellas 19, 20 converge with the lower ring 15 inside the recessed portion 27, 28. Thus, the upper end of lamellas 19, 20 is located above the lower edge 24 of the external peripheral skirt 11 and the lower end of lamellas 19, 20 is located below the upper edge of the lower ring 15. This arrangement gives the lamellas 19, 20 a sufficient length to allow the tilting of the cap 8 toward its open tilted position, while limiting the size of the circumferential interstice enabled between the cap 8 and the lower ring 15.

On the other hand, the cap 8 includes two anti-intrusion veils 29, 30 extending into the interior of each recessed portion 21, 22, respectively on each side of one of the lamellae 19, 20, in order to cover at least partially said recessed portion 21, 22. Anti-intrusion veils of this type 29, 30 thus allow preventing external bodies, such as particles, dust or unwanted organisms, insects or larvae, for example, from staying in the recessed portions 21, 22. In this way, they ensure the hygiene and safety of the capping device 1.

Each anti-intrusion veil 29, 30 is attached to the upper edge 23 and to one of the side edges 25, 26 of one of the recessed portions 21, 22. Each anti-intrusion veil 29, 30 also includes a side free edge 31 and a lower free edge 32 that converge. The lower free edge 32 extends from the lower end of one of the side edges 25, 26 in the extension of the lower edge 24 of the external peripheral skirt 11. The side free edge 31 extends, parallel to the adjacent lamella 19, 20. The side free edge 31 is separated from the blade 19, 20 by an interstice whose width is between 0.01 and 0.4 mm. In this way, the interstice has a width sufficiently scarce to prevent most of the external bodies from being housed there, being at the same time important enough not to run the risk of disturbing the functionalities of the 19 lamellas, 20 and to be compatible with the constraints of the molding procedure.

The anti-intrusion veils 29, 30 have a thickness smaller than that of the external peripheral skirt 11, which is particularly advantageous. In fact, the thinner the thickness of the anti-intrusion veils 29, 30, the fewer the restrictions that are exerted, during molding operations, on each sheet of the mold designed to enable the interstice between one of the anti-intrusion veils 29, 30 and the adjacent lamella 19, 20. Taking into account the minor restrictions exerted on these sheets, they may have a smaller thickness, which, therefore, allows reducing the width of the interstice enabled between the anti-intrusion veils 29, 30 and the lamellas 19, 20. Thus, the anti-intrusion veils 29, 30 advantageously have a thickness of between 0.05 and 0.5 mm.

Figure 5:
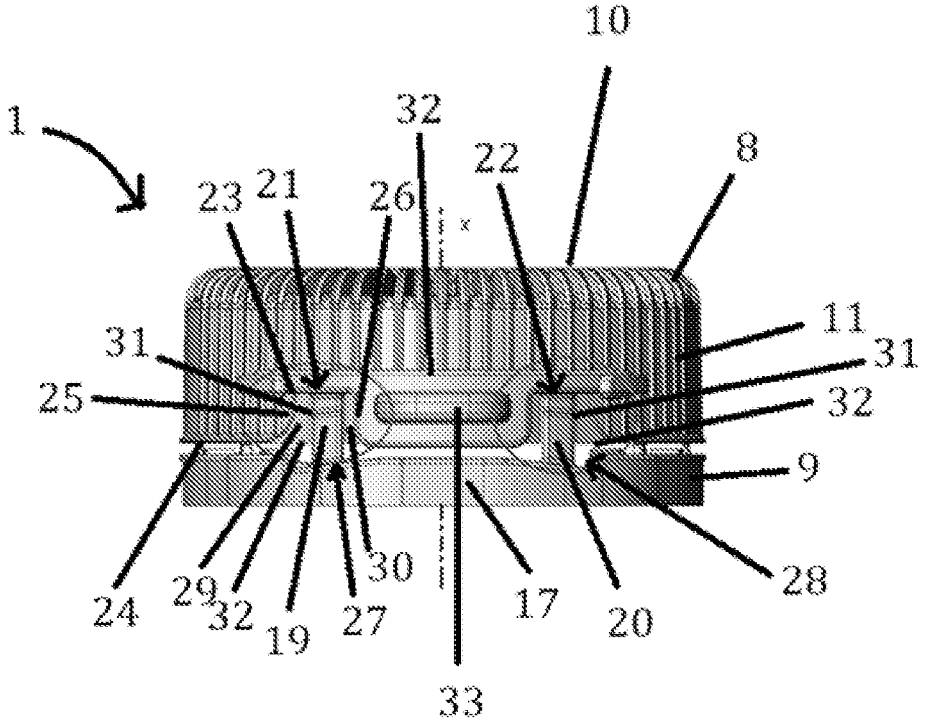
FIG. 5 is a detailed view of the articulation device of the capping device in FIGS. 1 3 and 4.

On the other hand, by way of example, in the embodiment represented, the locking device includes a heel 32, visible, in particular, in FIGS. 1 3 and 5, which is enabled in the outer peripheral skirt 11 of the cap 8. The heel 32 is arranged between the recessed portions 21, 22. The lower end of the heel is advantageously positioned at the same height as the lower end of the outer peripheral skirt 11. The heel 32 includes a stop 33 that extends circumferentially around the X-axis and protrudes radially outward from the heel 32.

During the movement of the cap 8 from the released position to the open tilted position, the stop 33 comes to rest against the upper end of the second section 17 of the lower ring 15, which tends to return that second section 17 to the lowered position. In addition, when the second section 17 of the lower ring 15 is in the lowered position and the cap 8 is in its open tilted position, the stop 33 is supported against the coupling collar 6. In this way, the cap 8 remains in its open tilted position, since, due to this support of the stop 33 against the coupling collar 6, the cap 8 cannot be pivoted to the released position wherein the cap 8 is in front of orifice 4 as long as the second section 17 of lower ring 15 remains in the lowered position.

Note that the locking device described above is described only by way of example and that the locking device 1 may be equipped with another type of locking device or very simply not equipped with a locking device, without leaving the framework of the invention, as defined by the claims.

Likewise, if the capping device 1 described above includes a cap 8 suitable for threading over the neck 3 of the container 2, the invention applies equally to caps intended to be pressed onto the neck 3 of the container 2, such as described, for example, in documents EP1406820 and US2018086510.

Figure 6:
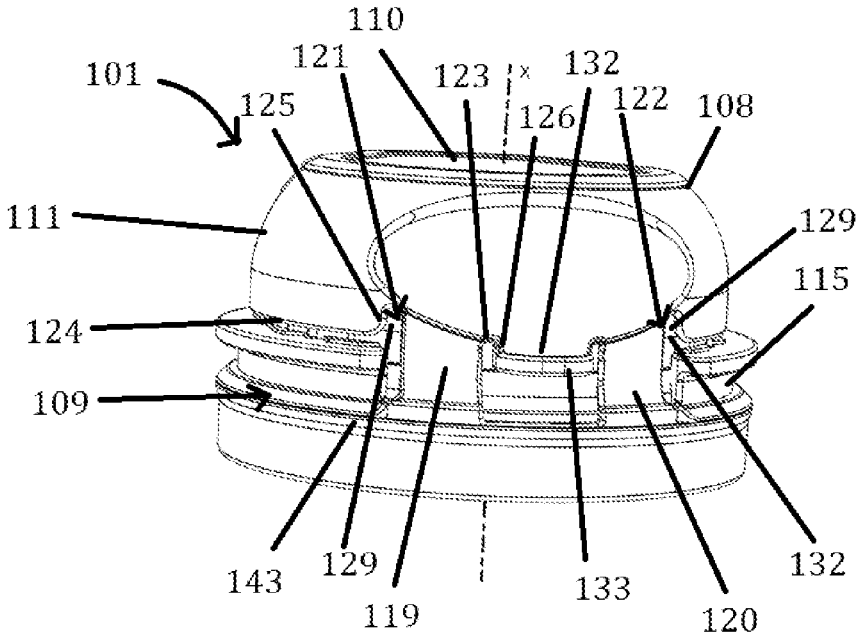
FIG. 6 illustrates a capping device according to a second embodiment.
Figure 7:
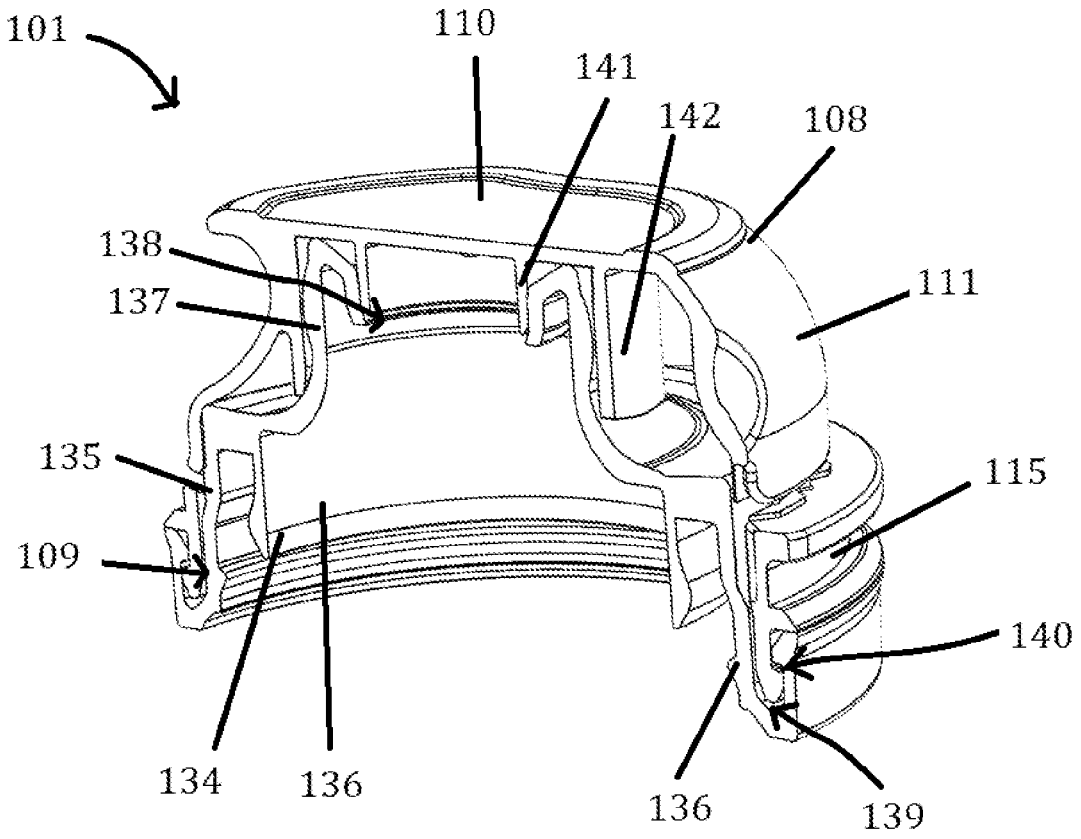
FIG. 7 is a cutaway view of the capping device in FIG. 6.

FIGS. 6 and 7 illustrate a capping device 101 according to a second embodiment. The elements identical or analogous to the elements in FIGS. 1 to 5, that is to say, those fulfilling the same function, carry the same reference number increased by 100.

The capping device 101 includes a pouring element 134, visible in FIG. 7, which is intended to be integral with the neck 3 of a container 2. The pouring element 134 includes an annular skirt 135 which is intended to surround the neck 3 of the container 2 and to be fixed there. To do this, the annular skirt 135 includes some engaging elements 136 which are intended to cooperate with a coupling collar 6 which protrudes radially from the neck 3 of the container 2. The pouring element 134 also includes an internal skirt 136 which is sized to be inserted into the orifice 4 of the neck 3 and is configured to ensure a sealing between the pouring element 134 and the orifice 4 of the container 2. The pouring element 134 also includes a pouring spout 137 equipped with an orifice 138 allowing the contents of the container 2 to be poured.

The pouring element 134 also includes an annular groove 139 which is enabled on the outside of the annular skirt 135. The capping device 101 includes a lower ring 115 which is intended to be secured inside the annular groove 139 of the pouring element 134 by snap fastening means 140, as shown in FIG. 7. The pouring element 134 and the lower ring 115 together form a base 109 intended to be attached to the neck 3 of the container 2.

The capping device 101 also includes a cap 108 which is intended to cover the orifice of the pouring element 134 to seal it, as well as a articulation device that joins the cap 108 to the base 9 and, more particularly, to the lower ring 115.

The cap 108 includes an upper wall 110 intended to be arranged substantially orthogonal to the X-axis, in front of the orifice of the pouring element 134 when said cap 108 is in a closed position. The cap 108 also includes an external peripheral skirt 111 extending downwards from the external periphery of said upper wall 110. The external peripheral skirt 111 is intended to surround the pouring element 134 when the cap 108 is in the closed position.

As shown in FIG. 7, the cap 108 includes an internal annular lip 141 extending perpendicularly downward from the upper wall 110 of the cap 108 and is sized to be inserted into the interior of the orifice 138 of the pouring element 134. The cap 108 also includes an external annular lip 142 extending downwards from the upper wall and is arranged radially between the internal annular lip 141 and the external peripheral skirt 111. The outer annular lip 142 and the inner annular lip 141 are sized so that, when the cap 108 is in the closed position, the inner annular lip 141 is in contact with the inner face of the pouring spout 137, while the external annular lip 142 is in contact with the external face of the pouring spout 137, which allows to ensure a sealing between the cap 108 and the pouring spout 137.

As in the previous embodiment, the capping device 101 includes a locking device arranged to lock the cap 108 in an open tilted position, not represented. In the represented embodiment, the locking device includes a heel 132 which is enabled on the external peripheral skirt 111 of the cap 108. The heel 135 is arranged between two recessed portions 121, 122 enabled on the outer peripheral skirt 111. The lower end of the heel 132 is located here below the lower edge 124 of the external peripheral skirt 111. The heel 132 includes a stop 133 that extends circumferentially around the X-axis and protrudes radially outward from the heel 132. The stop 133 is configured to be against the pouring element 134 and, more particularly, against a coupling collar 143 of the pouring element 134, when the cap 108 is in the open tilted position, to lock the cap 108 in this position.

The articulation device is illustrated in FIG. 6. As in the previous embodiment, the articulation device includes two lamellas 119, 120 that connect the external peripheral skirt 111 of the cap 108 to the lower ring 115. In addition, the external peripheral skirt 111 includes two recessed portions 121, 122. Each recessed portion 121, 122 is defined by an upper edge 123 and by two side edges 125, 126 extending respectively from one and the other of the two ends of the upper edge 123 and converging respectively with the lower edge 124 of the outer peripheral skirt 111 and the lower edge of the heel 132. In this embodiment, the upper edge 123 does not extend horizontally, as in the previous embodiment, but is inclined with respect to the horizontal and descends to converge with the heel 132. The end of the upper edge 123 of the recessed portion 121, 122 that converges with the heel 132 is arranged substantially at the same height as the lower edge 124 of the outer peripheral skirt 111, outside the area of the heel 132.

The cap 108 includes an anti-intrusion veil 129 that extends inside each recessed portion 121, 122, in order to cover an area thereof to prevent external bodies from getting to lodge there. Each anti-intrusion veil 129 is arranged, with respect to the lamella 119, 120 on the opposite side to the heel 132, that is, in the area of the recessed portion 121 that is located above the lower edge 124 of the outer peripheral skirt 111, outside the heel area 132. It is noted, that, in this embodiment, the area of each recessed portion 121, 122 that is located between the lamella 119, 120 and the heel 132 does not extend above the lower edge 124 of the outer peripheral skirt 111, so no anti-intrusion veil 129 arranged in this area is necessary.

Each anti-intrusion veil 129 is attached to the upper edge 123 of the recessed portion 121, 122, to the lamella 119, 120 and to the side edge 125 of the recessed portion 121, 122 opposite the heel 132. The anti-intrusion veil 129 includes a lower free edge 132 extending into the extension of the lower edge 124 of the external peripheral skirt 111. On the other hand, it is noted that, in this embodiment, the anti-intrusion veil 129 is also attached to one of the lamella 119, 120, so that there is no interstice between the lamella 119, 120 and the anti-intrusion veil 129, as in the previous embodiment. Also, the anti-intrusion veil 129 advantageously has a thickness smaller than that of the lamella 119, 120 and the outer peripheral skirt 111 in order to affect as little as possible the joint operation. The thickness of the anti-intrusion veil 129 is, for example, between 0.05 and 0.5 mm.

Although the invention has been described in relation to various particular embodiments, it is more than evident that it is in no way limited thereto and that it comprises all the technical equivalents of the described means, as well as their combinations if these fall within the framework of the invention as defined by the claims.

The use of the verb "to include", "to comprise" or "to consist of" and their conjugated forms does not exclude the presence of other elements or of other stages than those stated in a claim.

In the claims, any reference sign in parentheses is not to be interpreted as a limitation of the claim.

The invention claimed is:

1. A capping device including:

a base intended to be fixed to a container;

a cap including an upper wall and an external peripheral skirt, the cap being suitable and intended to be arranged in a closing position wherein the upper wall covers an orifice; and an articulation device that connects the cap to the base, the articulation device including at least one first lamella that connects the outer peripheral skirt of the cap to the base, the outer peripheral skirt having a first recessed portion that includes an upper edge extending above a lower edge of that outer peripheral skirt and a first side edge connecting the upper edge from the first recessed portion to the lower edge of the outer peripheral skirt, the first lamella being attached to the upper edge of the first recessed portion, the cap including at least one first anti-intrusion veil which has a thickness smaller than that of the outer peripheral skirt, the first anti-intrusion veil extending from the upper edge and from the first side edge of the first recessed portion inside the first recessed portion;

wherein the first anti-intrusion veil includes a lower free edge extending on an extension of the lower edge of said outer peripheral skirt.

2. Capping device according to claim 1, wherein the first anti-intrusion veil has a thickness between 0.05 and 0.5 mm.

3. Capping device according to claim 1, wherein the first anti-intrusion veil includes a side free edge extending parallel to a side edge of the first lamella.

4. Capping device according to claim 3, wherein the side free edge of the first anti-intrusion veil is separated from the first lamella by an interstice having a width between 0.01 and 0.4 mm.

5. Capping device according to claim 3, wherein the first recessed portion includes a second side edge connecting the upper edge of the first recessed portion to the lower edge of the outer peripheral skirt, the first side edge and the second side edge of the first recessed portion being arranged on each side of the first lamella, the cap including a second anti-intrusion veil having a thickness smaller than that of the outer peripheral skirt, this second anti-intrusion veil extends from the upper edge of the first recessed portion and from the second side edge of the first recessed portion, inside the first recessed portion.

6. Capping device according to claim 1, wherein the articulation device includes a second lamella connecting the outer peripheral skirt of the cap to the base, the outer peripheral skirt having a second recessed portion that includes an upper edge extending above the lower edge of the outer peripheral skirt and a first side edge connecting the upper edge of the second recessed portion to the lower edge of the outer peripheral skirt, the second lamella being attached to the upper edge of the second recessed portion, the cap including, for each of the first and second recessed portions, at least one first anti-intrusion veil that has a thickness smaller than that of the outer peripheral skirt, and that extends from the upper edge and the first side edge of the first or second recessed portion, inside said first or second recessed portion.

7. Capping device according to claim 1, wherein the base includes a lower ring which is intended to be retained at the neck of the container.

8. Capping device according to claim 1, wherein the base includes a pouring element which is intended to be integral with the neck of the container.

9. An assembly comprising a container fitted with a neck including an orifice and a capping device according to claim 1, with the base of said capping device fixed to the container.

* * * * *